US006317104B1

(12) United States Patent
Kasahara et al.

(10) Patent No.: US 6,317,104 B1
(45) Date of Patent: Nov. 13, 2001

(54) PLASMA DISPLAY PANEL DRIVE PULSE CONTROLLER FOR PREVENTING FLUCTUATION IN SUBFRAME LOCATION

(75) Inventors: Mitsuhiro Kasahara, Hirakata; Yuichi Ishikawa, Ibaraki; Tomoko Morita, Hirakata, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/355,331

(22) PCT Filed: Dec. 7, 1998

(86) PCT No.: PCT/JP98/05509

§ 371 Date: Aug. 3, 1999

§ 102(e) Date: Aug. 3, 1999

(87) PCT Pub. No.: WO00/19400

PCT Pub. Date: Apr. 6, 2000

(30) Foreign Application Priority Data

Sep. 25, 1998 (JP) ..... 10-271999

(51) Int. Cl.[7] ..... G09G 3/28

(52) U.S. Cl. ..... 345/63; 345/147; 345/89

(58) Field of Search ..... 345/60, 63, 77, 345/89, 147, 148, 99, 204, 207, 211; 348/797

(56) References Cited

U.S. PATENT DOCUMENTS 5,187,578 * 2/1993 Koghami ..... 348/687
5,757,343 5/1998 Nagakubo .
5,999,154 * 12/1999 Yoshioka ..... 345/89
6,025,818 * 2/2000 Okano ..... 345/63

FOREIGN PATENT DOCUMENTS 61-98389 5/1986 (JP) .
6259034 9/1994 (JP) .
8286636 11/1996 (JP) .
9127911 5/1997 (JP) .
10207426 8/1998 (JP) .
95/27970 10/1995 (WO) .

OTHER PUBLICATIONS

JP06–259034–A English Translation, Sep. 16, 1994.*
An English Language abstract of JP 9–127911.
An English Language abstract of JP 8–286636.
An English Language abstract of JP 10–207426.
An English Language abstract of JP 6–259034.
An English Language translation of the related portions of JP 10–207426.

* cited by examiner

*Primary Examiner*—Regina Liang
*Assistant Examiner*—Alexander Eisen
(74) *Attorney, Agent, or Firm*—Greenblum & Bernstein, P.L.C.

(57) ABSTRACT

A delay device is provided so that the light emission end point of a most-weighted subfield corresponds to the end point of each field. Alternatively, the light emission center point of a most-weighted subfield appear in the same location in a field. Thus, the light emission center point of the subfield with the largest number of light emissions, that is, the most-weighted subfield, appear in approximately the same location for all fields in a plasma display panel PDP driving signal.

10 Claims, 11 Drawing Sheets

Fig.1A

SF1

```
0000000000
0111110000
0100000000
0101110000
```

Fig.1B

SF2

```
0000000000
0111110000
0111110000
0110000000
```

Fig.1C

SF3

```
0000000000
0111110000
0111110000
0111110000
```

Fig.1D

SF4

```
0000000000
0111110000
0111110000
0111110000
```

Fig.1E

SF5

```
0000000000
0111110000
0111110000
0111110000
```

Fig.1F

SF6

```
0000000000
0111110000
0111110000
0111110000
```

Fig.1G

SF7

```
0000000000
0111110000
0111110000
0111110000
```

Fig.1H

SF8

```
1111110000
1000000000
1000000000
1000000000
```

1-TIMES MODE
8 SUBFIELDS
256 GRADATIONS

1-TIMES MODE
9 SUBFIELDS
256 GRADATIONS

12 SUBFIELDS

11 SUBFIELDS

PLASMA DISPLAY PANEL DRIVE PULSE CONTROLLER FOR PREVENTING FLUCTUATION IN SUBFRAME LOCATION

TECHNICAL FIELD

The present invention relates to a display apparatus, and more particularly, to a display apparatus of a plasma display panel (PDP), and digital micromirror device (DMD).

BACKGROUND ART

A display apparatus of a PDP and a DMD makes use of a subfield method, which has binary memory, and which displays a dynamic image possessing half tones by temporally superimposing a plurality of binary images that have each been weighted. The following explanation deals with PDP, but applies equally to DMD as well.

The PDP subfield method is explained using FIGS. 1, 2, 3.

Now, consider a PDP with pixels lined up 10 horizontally and 4 vertically, as shown in FIG. 3. Assume that the respective R,G,B of each pixel is 8 bits, the brightness thereof is rendered, and that a brightness rendering of 256 gradations (256 gray scales) is possible. The following explanation, unless otherwise stated, deals with a G signal, but the explanation applies equally to R, B as well.

The portion indicated by A in FIG. 3 has a brightness signal level of 128. If this is represented in binary, a (1000 0000) signal level is added to each pixel in the portion indicated by A. Similarly, the portion indicated by B has a brightness of 127, and a (0111 1111) signal level is added to each pixel. The portion indicated by C has a brightness of 126, and a (0111 1110) signal level is added to each pixel. The portion indicated by D has a brightness of 125, and a (0111 1101) signal level is added to each pixel. The portion indicated by E has a brightness of 0, and a (0000 0000) signal level is added to each pixel. Lining up an 8-bit signal for each pixel perpendicularly in each pixel location, and horizontally slicing it bit-by-bit produces a subfield. That is, in an image display method, which utilizes the so-called subfield method, by which 1 field is divided into a plurality of differently weighted binary images, and displayed by temporally superimposing these binary images, a subfield is 1 of the divided binary images.

Since each pixel is represented by 8 bits, as shown in FIG. 2, 8 subfields can be achieved. Collect the least significant bit of the 8-bit signal of each pixel, line them up in a 10×4 matrix, and let that be subfield SF1 (FIG. 2). Collect the second bit from the least significant bit, line them up similarly into a matrix, and let this be subfield SF2. Doing this creates subfields SF1, SF2, SF3, SF4, SF5, SF6, SF7, SF8. Needless to say, subfield SF8 is formed by collecting and lining up the most significant bits.

FIG. 4 shows the standard form of 1 field of a PDP driving signal. As shown in FIG. 4, there are 8 subfields SF1, SF2, SF3, SF4, SF5, SF6, SF7, SF8 in the standard form of a PDP driving signal, and subfields SF1 through SF8 are processed in order, and all processing is performed within 1 field time. The processing of each subfield is explained using FIG. 4. The processing of each subfield is comprised of setup period P1, write period P2, sustain period P3, and erase period P4. At setup period P1, a single pulse is applied to a holding electrode E0, and a single pulse is also applied to each scanning electrode E1, E2, E4 (There are only up to 4 scanning electrodes indicated in FIG. 4 because there are only 4 scanning lines shown in the example in FIG. 3, but in reality, there are a plurality of scanning electrodes, 480, for example.). In accordance with this, preliminary discharge is performed.

At write period P2, a horizontal-direction scanning electrode scans sequentially, and a prescribed write is performed only to a pixel that received a pulse from a data electrode E5. For example, when processing subfield SF1, a write is performed for a pixel represented by "1" in subfield SF1 depicted in FIG. 2, and a write is not performed for a pixel represented by "0."

At sustain period P3, a sustaining electrode (drive pulse) is outputted in accordance with the weighted value of each subfield. For a written pixel represented by "1," a plasma discharge is performed for each sustaining electrode, and the brightness of a predetermined pixel is achieved with one plasma discharge. In subfield SF1, since weighting is "1," a brightness level of "1" is achieved. In subfield SF2, since weighting is "2," a brightness level of "2" is achieved. That is, write period P2 is the time when a pixel which is to emit light is selected, and sustain period P3 is the time when light is emitted a number of times that accords with the weighting quantity.

At erase period P4, residual charge is all erased.

As shown in FIG. 4, subfields SF1, SF2, SF3, SF4, SF5, SF6, SF7, SF8 are weighted at 1, 2, 4, 8, 16, 32, 64, 128, respectively. Therefore, the brightness level of each pixel can be adjusted using 256 gradations, from 0 to 255.

In the B region of FIG. 3, light is emitted in subfields SF1, SF2, SF3, SF4, SF5, SF6, SF7, but light is not emitted in subfield SF8. Therefore, a brightness level of "127" (=1+2+4+8+16+32+64) is achieved.

And in the A region of FIG. 3, light is not emitted in subfields SF1, SF2, SF3, SF4, SF5, SF6, SF7, but light is emitted in subfield SF8. Therefore, a brightness level of "128" is achieved.

There are a number of variations of PDP driving signals relative to the standard form of PDP driving signal shown in FIG. 4, and such variations are explained.

FIG. 5 shows a 2-times mode PDP driving signal. Furthermore, the PDP driving signal shown in FIG. 4 is a 1-times mode. For the 1-times mode of FIG. 4, the number of sustaining electrodes comprising sustain period P3 in subfields SF1 through SF8, that is, the weighting values, were 1, 2, 4, 8, 16, 32, 64, 128, respectively, but for the 2-times mode of FIG. 5, the number of sustaining electrodes comprising sustain period P3 in subfields SF1 through SF8 become 2, 4, 8, 16, 32, 64, 128, 256, respectively, with all subfields being doubled. In accordance with this, compared to a standard form PDP driving signal that is a 1-times mode, a 2-times mode PDP driving signal can display an image with 2 times the brightness.

FIG. 6 shows a 3-times mode PDP driving signal. Therefore, the number of sustaining electrodes comprising sustain period P3 in subfields SF1 through SF8 becomes 3, 6, 12, 24, 48, 96, 192, 384, respectively, with all subfields being tripled.

By so doing, although dependent on the degree of margin in 1 field, it is possible to create a maximum 6-times mode PDP driving signal. In accordance with this, it becomes possible to display an image with 6 times the brightness.

Here, a mode multiplier is generally expressed as N times. Furthermore, this N can also be expressed as a weighting multiplier N.

FIG. 7(A) shows a standard form PDP driving signal, and FIG. 7(B) shows a variation of a PDP driving signal, which, by adding 1 subfield, comprises subfields SF1 through SF9. For the standard form, the final subfield SF8 is weighted by a sustaining electrode of 128, and for the variation in FIG. 7(B), each of the last 2 subfields SF8, SF9 is weighted by a sustaining electrode of 64. For example, when a brightness level of 130 is represented, with the standard form of FIG. 7(A), this can be achieved using both subfield SF2 (weighted 2) and subfield SF8 (weighted 128), whereas with the variation of FIG. 7(B), this brightness level can be achieved using 3 subfields, subfield SF2 (weighted 2), subfield SF8 (weighted 64), and subfield SF9 (weighted 64). By increasing the number of subfields in this way, it is possible to decrease the weight of the subfield with the greatest weight. Decreasing the weight like this enables pseudo-contour noise to be decreased, giving the display of an image greater clarity.

Here, the number of subfields is generally expressed as Z. For the standard form of FIG. 7(A), the subfield number Z is 8, and 1 pixel is represented by 8 bits. As for FIG. 7(B), the subfield number Z is 9, and 1 pixel is represented by 9 bits. That is, in the case of the subfield number Z, 1 pixel is represented by Z bits.

FIG. 8 shows the development of a PDP driving signal in the past. When a PDP driving signal changed from a certain field to the next field, if the subfield number Z changed, or the mode number N changed, the light emission center point of the subfield with the largest number of light emissions in each field (hereinafter referred to as the most-weighted subfield) moved.

Here, the light emission center point refers to the center point between the point in time of light emission start, which is the leading edge of sustain period for a certain subfield, and the point in time of light emission end, which is the trailing edge of sustain period for a certain subfield.

FIG. 8A shows a field, in which the subfield number Z is 12, and the light emission center point of the most-weighted subfield SF12 is C1. FIG. 8B shows a field, in which the subfield number Z is 11, and the light emission center point of the most-weighted subfield SF11 is C2. In general, light emission is performed sequentially from the subfield with the smallest number of light emissions to the subfield with the largest number of light emissions. Now, if it is assumed that a change is made from the field of FIG. 8A to the field of FIG. 8B, a time difference Td is generated between the time from the leading edge of the field of FIG. 8A to C1, and the leading edge of the field of FIG. 8B to C2. This time difference Td causes an unnatural fluctuation in image brightness.

Because the most-weighted subfield undertakes the largest number of light emissions for the field in which this subfield exists, it greatly effects the brightness of that field. The length of 1 field, for example, is 16.666 msec. If the light emission center points of the most-weighted subfields appear at the same cycle (for example, 16.666 msec) for a plurality of fields, this can be seen as a natural brightness change, but if the light emission center points of the most-weighted subfields appear as either contiguous or separate, a person viewing the screen will sense an unnatural brightness fluctuation.

The present invention proposes a PDP display drive pulse controller for preventing light emission center fluctuation, by which the light emission center point of a most-weighted subfield does not fluctuate even when a subfield number Z changes, and/or a mode number N, that is, a weighting multiplier N changes.

DISCLOSURE OF INVENTION

According to the present invention, a drive pulse controller for creating, for each picture, Z subfields from a first to a Zth in accordance with Z bit representation of each pixel, a weighting value for weighting to each subfield, and a multiplier N for multiplying said weighting value with said N, said PDP display drive pulse controller comprises:

means for specifying a subfield number Z, and a weighting multiplier N;

a time data source, which holds light emission time data on a most-weighted subfield, which has the largest number of light emissions of all subfields;

means for selecting light emission time data of the specified most-weighted subfield based on a specified subfield number Z and weighting multiplier N;

means for calculating a delay time for positioning the most-weighted subfield of all subfields in a predetermined location based on time data; and delay means for delaying a drive pulse in accordance with a calculated delay time, and in that it positions the location of the most-weighted subfield in 1 field in an approximate predetermined location.

According to the drive pulse controller of the present invention, the light emission time data, which is held in said time data source, is the light emission end point of a most-weighted subfield.

According to the drive pulse controller of the present invention, the light emission time data, which is held in said time data source, is the light emission start point and the light emission end point of a most-weighted subfield.

According to the drive pulse controller of the present invention, said means for calculating said delay time calculates the time difference between the light emission end point of a most-weighted subfield and the end point of a field.

According to the drive pulse controller of the present invention, said means for calculating said delay time calculates the time difference between the light emission center point, which is in the center between the light emission start point and light emission end point, and a predetermined point within a field.

BRIEF DESCRIPTION OF DRAWINGS

FIGS. 1A to 1H illustrate diagrams of separate subfields SF1–SF8.

BEST MODE FOR CARRYING OUT THE INVENTION

Figure 9:
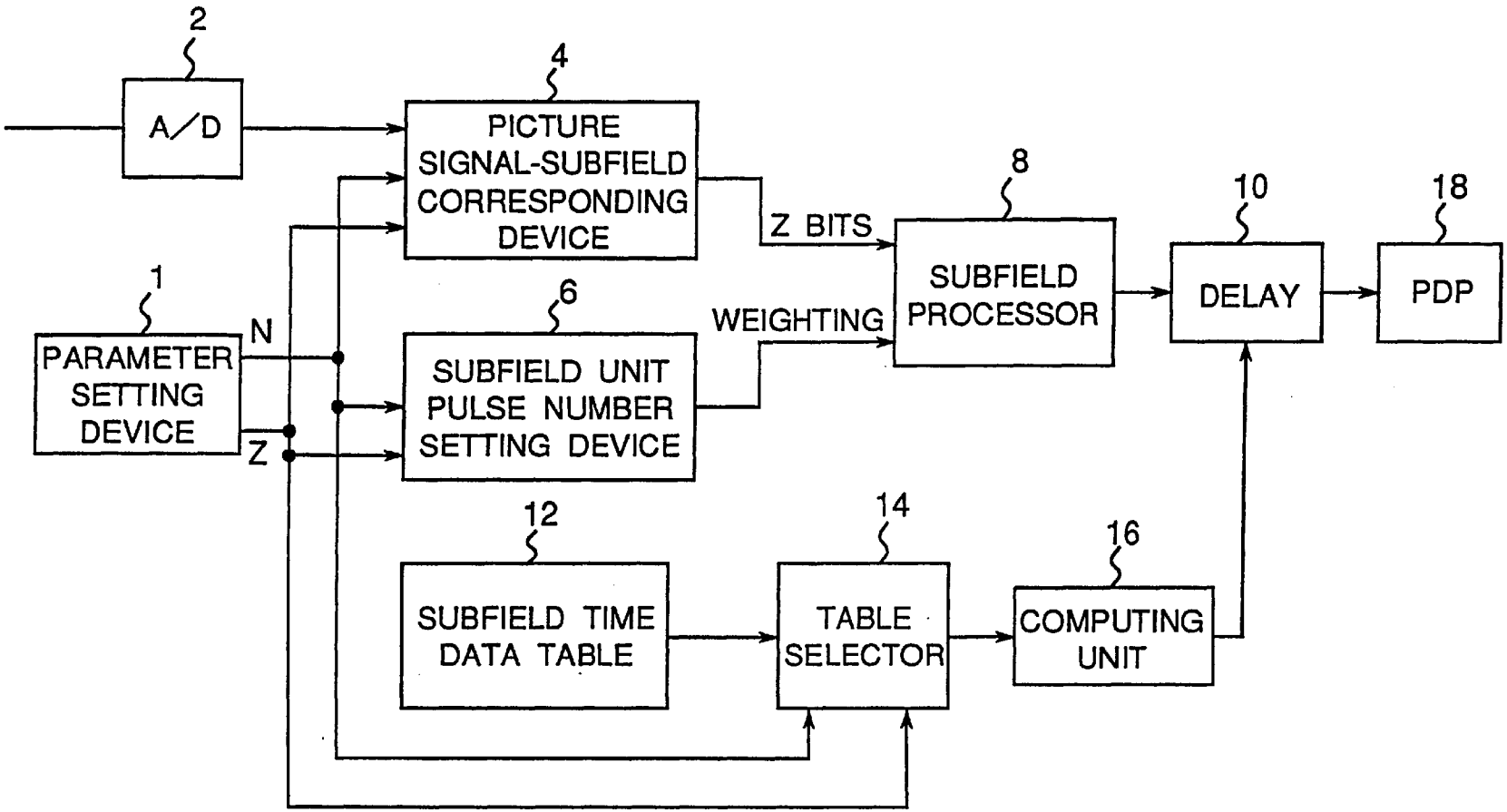
FIG. 9 show a block diagram of a PDP display drive pulse controller of a first embodiment.

FIG. 9 shows a first embodiment of a PDP display drive pulse controller for preventing light emission center fluctuation, related to the present invention. In FIG. 9, a parameter setting device 1 sets a subfield number Z and weighting multiplier N on the basis of brightness and various other data. An A/D (Analog-to-Digital) converter 2 converts an inputted picture signal to an 8-bit digital signal. A picture signal-subfield corresponding device 4 receives a subfield number Z and a weighting multiplier N, and changes the 8-bit signal sent from the A/D converter 2 to a Z-bit signal.

A subfield unit pulse number setting device 6 receives a subfield number Z and a weighting multiplier N, and specifies the weighting, that is, the number of sustaining electrodes required for each subfield.

A subfield processor 8 outputs a sustaining electrode for sustain period P3 in accordance with data from the subfield unit pulse number setting device 6 for a "1" bit of Z bits.

Further, in the subfield processor 8, setup period P1 (for example, 140 $\mu$s) and write period P2 (for example, 340 $\mu$s) are inserted at the head of each subfield, and a pulse signal in proportion to the number of sustaining electrodes determined by the subfield unit pulse number setting device 6, is applied in sustain period P3. And at the end of each subfield, an erase period P4 (for example, 40 $\mu$s) is inserted. Further, 1 cycle of a sustaining electrode is 5 $\mu$s, for example.

A PDP driving signal created in this way is delayed by a delay circuit 10, and a picture is displayed on a plasma display panel 18.

Details concerning the parameter setting device 1, A/D converter 2, picture signal-subfield corresponding device 4, subfield unit pulse number setting device 6, and subfield processor 8 are disclosed in the specification of patent application no. (1998)-271030 (Title: Display Capable of Adjusting Subfield Number in Accordance with Brightness) submitted on the same date as this application by the same applicant and the same inventor.

The below-listed Table 1, Table 2, Table 3, Table 4, Table 5, Table 6 are held in a subfield time data table 12.

TABLE 1

| ×1 Mode unit: ms | | |
|---|---|---|
| Z | Ls | Le |
| 8 | 4.755 | 5.395 |
| 9 | 5.595 | 5.915 |
| 10 | 6.195 | 6.435 |
| 11 | 6.775 | 6.955 |
| 12 | 7.315 | 7.475 |
| 13 | 7.855 | 7.995 |
| 14 | 8.395 | 8.515 |

TABLE 2

| ×2 Mode unit: ms | | |
|---|---|---|
| Z | Ls | Le |
| 8 | 5.390 | 6.670 |
| 9 | 6.550 | 7.190 |
| 10 | 7.230 | 7.710 |
| 11 | 7.870 | 8.230 |

TABLE 2-continued

| ×2 Mode unit: ms | | |
|---|---|---|
| Z | Ls | Le |
| 12 | 8.430 | 8.750 |
| 13 | 8.990 | 9.270 |
| 14 | 9.550 | 9.790 |

TABLE 3

| ×3 Mode unit: ms | | |
|---|---|---|
| Z | Ls | Le |
| 8 | 6.025 | 7.945 |
| 9 | 7.505 | 8.465 |
| 10 | 8.265 | 8.985 |
| 11 | 8.965 | 9.505 |
| 12 | 9.545 | 10.025 |
| 13 | 10.125 | 10.545 |
| 14 | 10.705 | 11.065 |

TABLE 4

| ×4 Mode unit: ms | | |
|---|---|---|
| Z | Ls | Le |
| 8 | 6.660 | 9.220 |
| 9 | 8.460 | 9.740 |
| 10 | 9.300 | 10.260 |
| 11 | 10.060 | 10.780 |
| 12 | 10.660 | 10.300 |
| 13 | 11.260 | 10.820 |
| 14 | 11.860 | 12.340 |

TABLE 5

| ×5 Mode unit: ms | | |
|---|---|---|
| Z | Ls | Le |
| 8 | 7.295 | 10.495 |
| 9 | 9.415 | 11.015 |
| 10 | 10.335 | 11.535 |
| 11 | 11.155 | 12.055 |
| 12 | 11.775 | 12.575 |
| 13 | 12.395 | 13.095 |
| 14 | 13.015 | 13.615 |

TABLE 6

| ×6 Mode unit: ms | | |
|---|---|---|
| Z | Ls | Le |
| 8 | 7.930 | 11.770 |
| 9 | 10.370 | 12.290 |
| 10 | 11.370 | 12.810 |
| 11 | 12.250 | 13.330 |
| 12 | 12.890 | 13.850 |
| 13 | 13.530 | 14.370 |
| 14 | 14.170 | 14.890 |

Table 1 lists the light emission start point Ls and light emission end point Le of a 1-times mode most-weighted subfield when the subfield number Z is 8, 9, 10, 11, 12, 13, 14, respectively. The unit of the numerals in the table is milliseconds. The same holds true for the other tables. A light emission start point Ls is expressed as the temporal duration from the leading edge of a field to the light emission start point, and is calculated by using the following formula (1).

$$Ls=(P1+P2)\times SFM+\Sigma f(SFM-1)\times P3+P4\times(SFM-1) \quad (1)$$

Here, P1 is setup period (for example, 140 μs), P2 is write period (for example, 340 μs), P3 is 1 cycle time of a sustaining electrode (for example, 5 μs), P4 is erase period (for example, 40 μs), SFM is the subfield number of the most-weighted subfield, Σf(SFM−1) is the total number of sustaining electrodes from subfield SF1 to the subfield immediately prior to the most-weighted subfield. Since the most-weighted subfield appears last in each field, SFM is equivalent to the subfield number in a table.

Further, the light emission end point Le is expressed as the temporal duration from the leading edge of a field to the light emission end point, and is calculated by using the following formula (2).

$$Le=Ls+f(SFM)\times P3 \quad (2)$$

Here, f(SFM) is the total number of sustaining electrodes in the most-weighted subfield.

Similarly, Table 2, Table 3, Table 4, Table 5, Table 6 list the light emission start point Ls and light emission end point Le for each of a 2-times, 3-times, 4-times, 5-times, 6-times mode most-weighted subfield when the subfield number Z is 8, 9, 10, 11, 12, 13, 14, respectively.

A table selector 14 receives a subfield number Z and weighting multiplier N, and, in addition to selecting a table that accords with the multiplier N, obtains from the selected table the light emission end point Le of a most-weighted subfield that accords with the subfield number Z. Furthermore, since data on the light emission start point Ls of a most-weighted subfield is not required in the embodiment shown in FIG. 9, FIG. 10, the light emission start point row in each table can be omitted, and the data quantity of the table can be reduced.

A computing unit 16 performs the operation of the following formula (3), calculating delay time Dx.

$$Dx=Ft-(Le+P4) \quad (3)$$

Here, Ft is 1 field time (for example, 16.666 ms).

Figure 2:
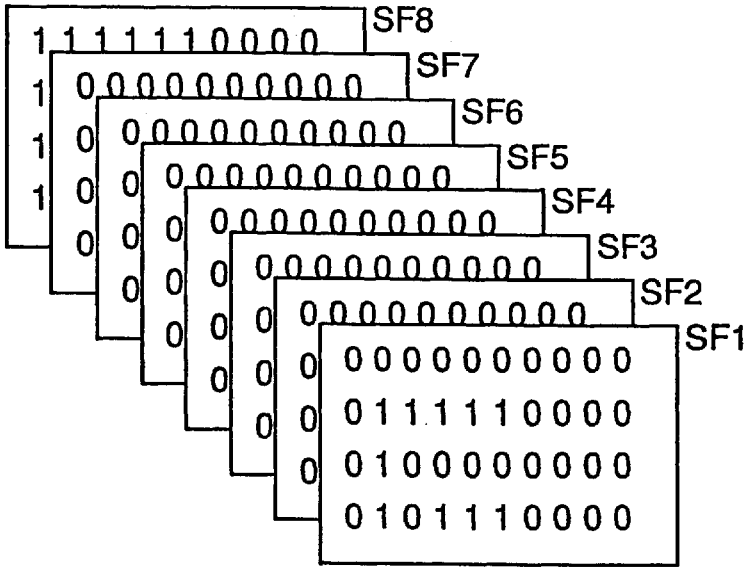
FIG. 2 illustrates a diagram in which subfields SF1–SF8 overlay one another.
Figure 3:
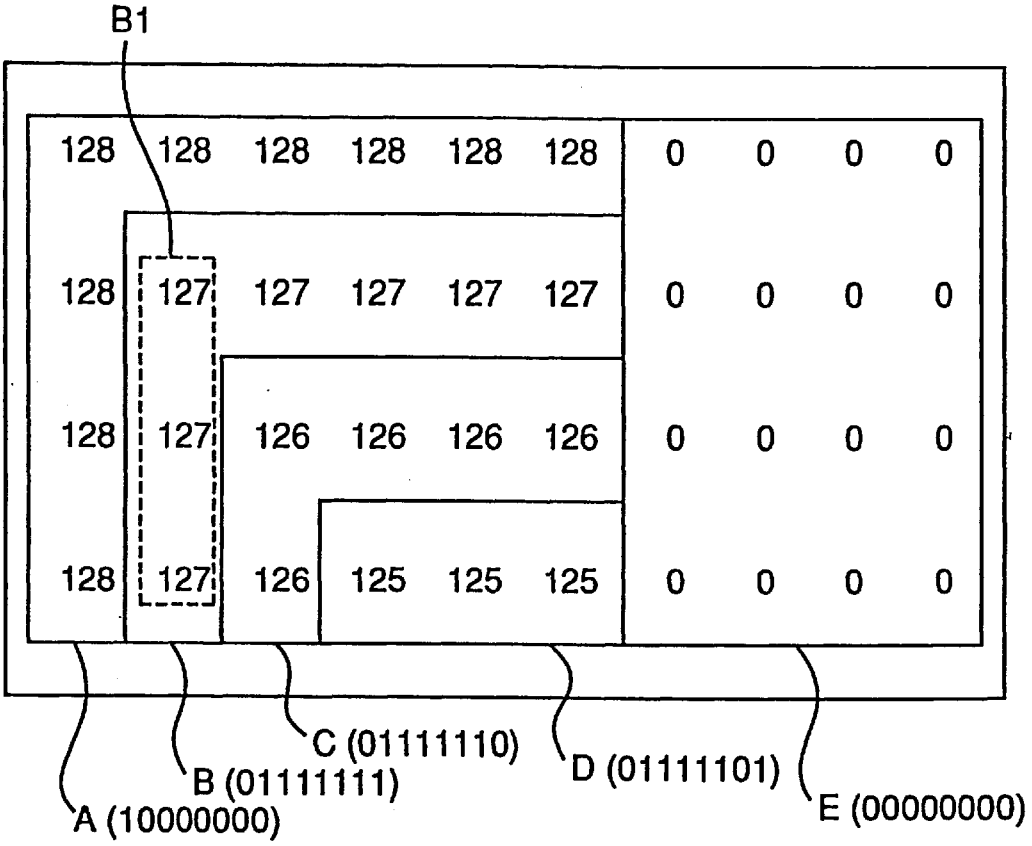
FIG. 3 shows a diagram of an example of PDP screen brightness distribution.
Figure 4:
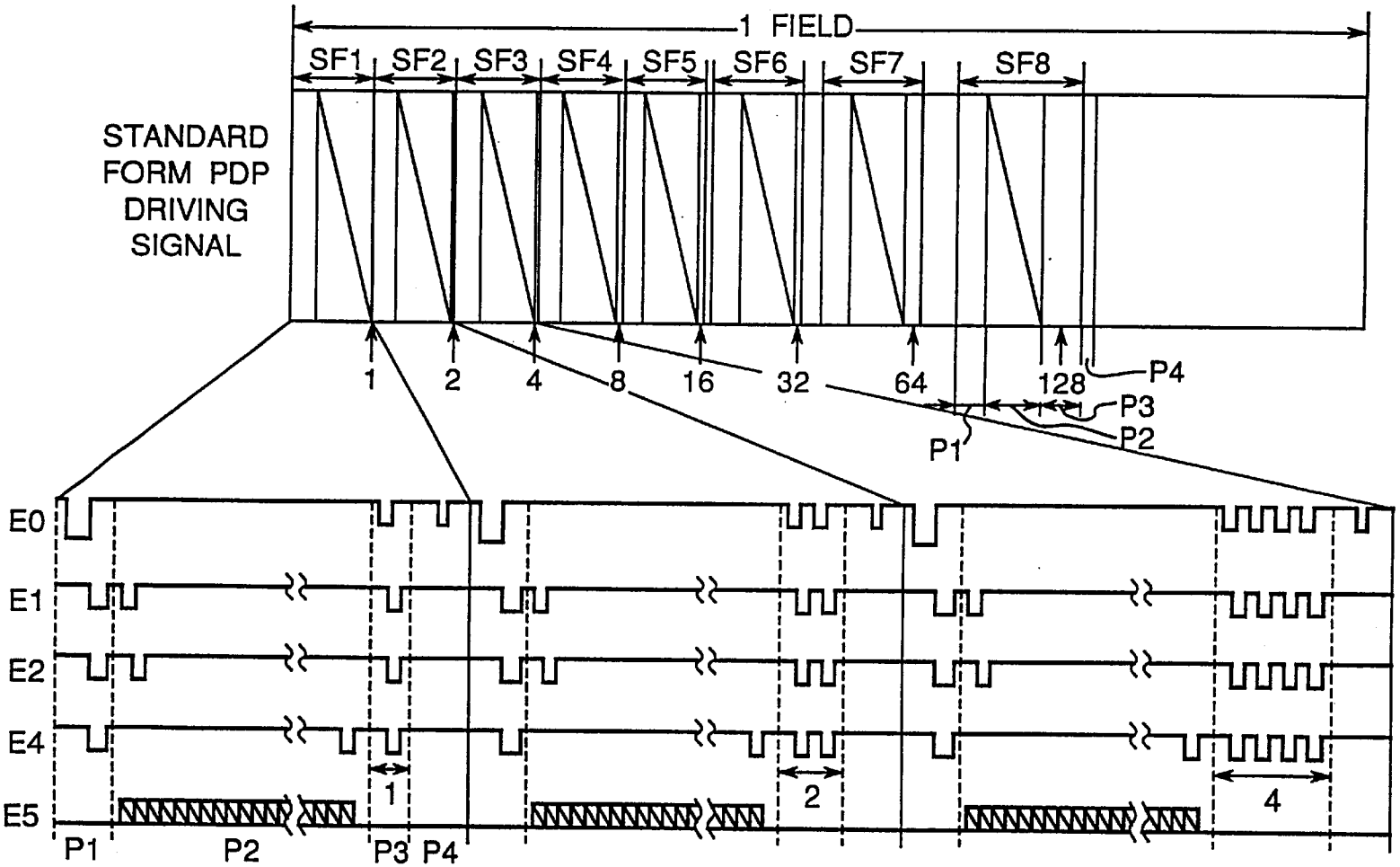
FIG. 4 shows a waveform diagram showing the standard form of a PDP driving signal.
Figure 5:
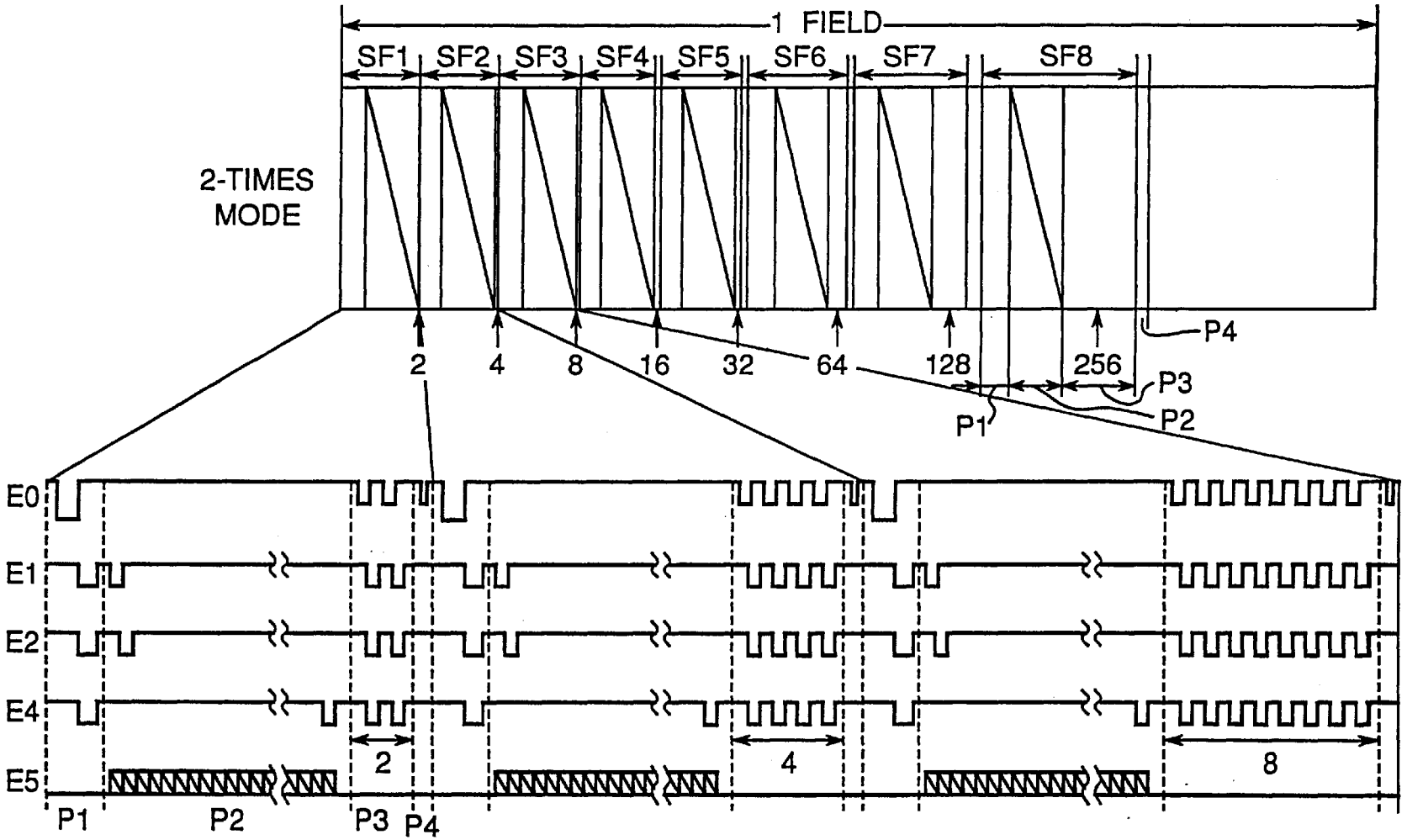
FIG. 5 shows a waveform diagram showing a 2-times mode of a PDP driving signal.
Figure 6:
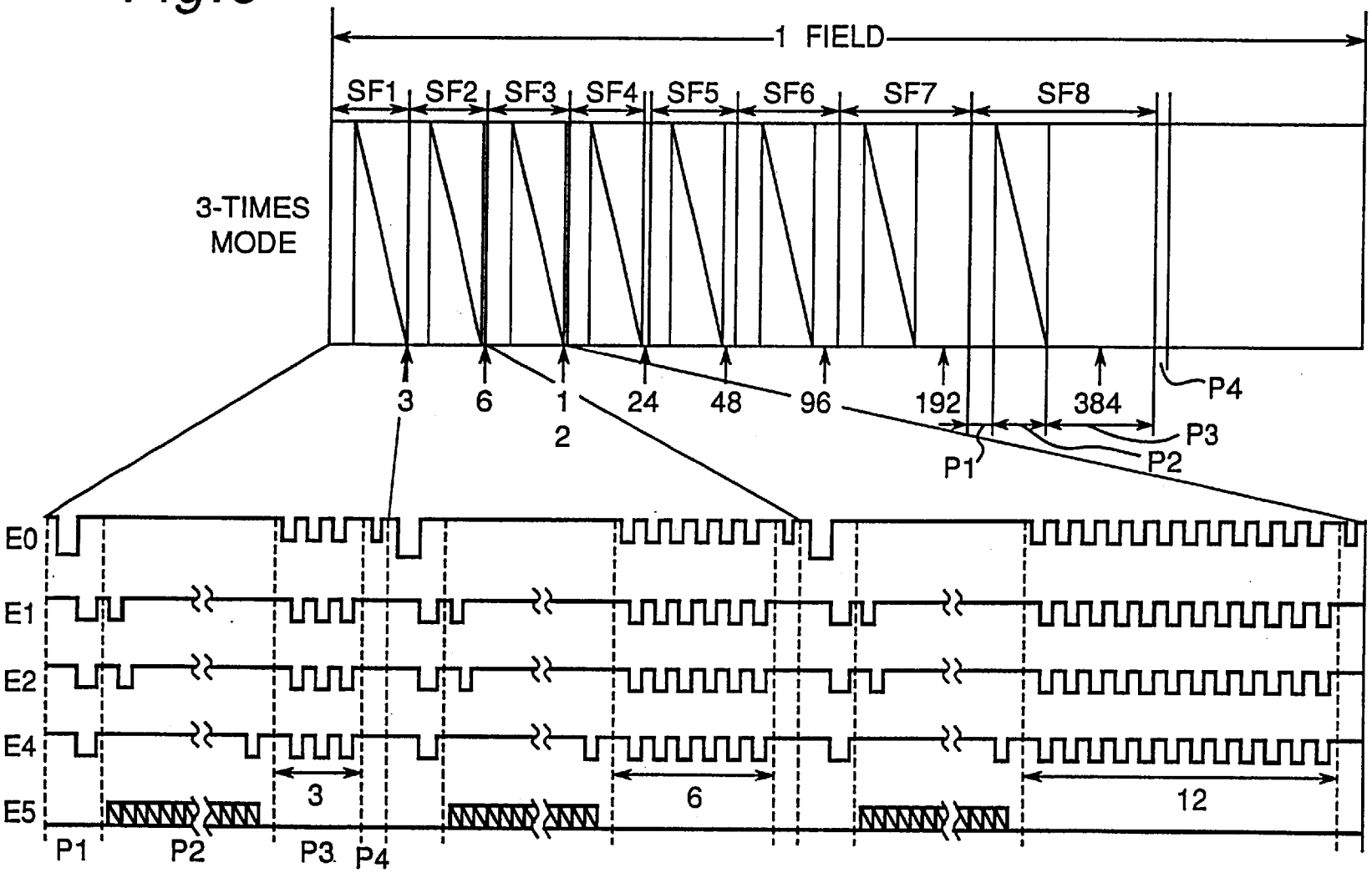
FIG. 6 shows a waveform diagram showing a 3-times mode of a PDP driving signal.
Figure 7A:
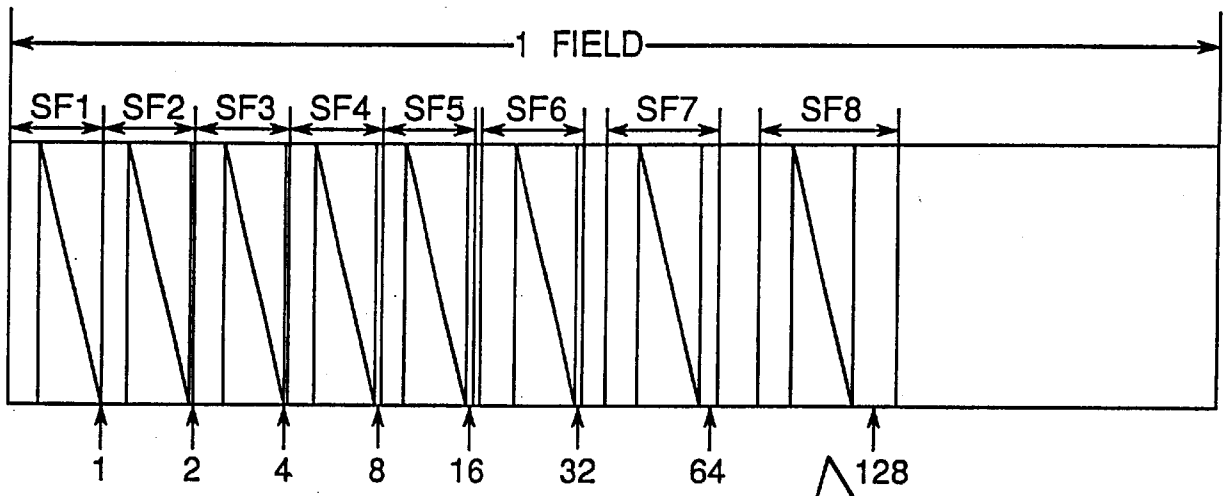
FIG. 7A shows a waveform diagram of a standard form of PDP driving signal.
Figure 7B:
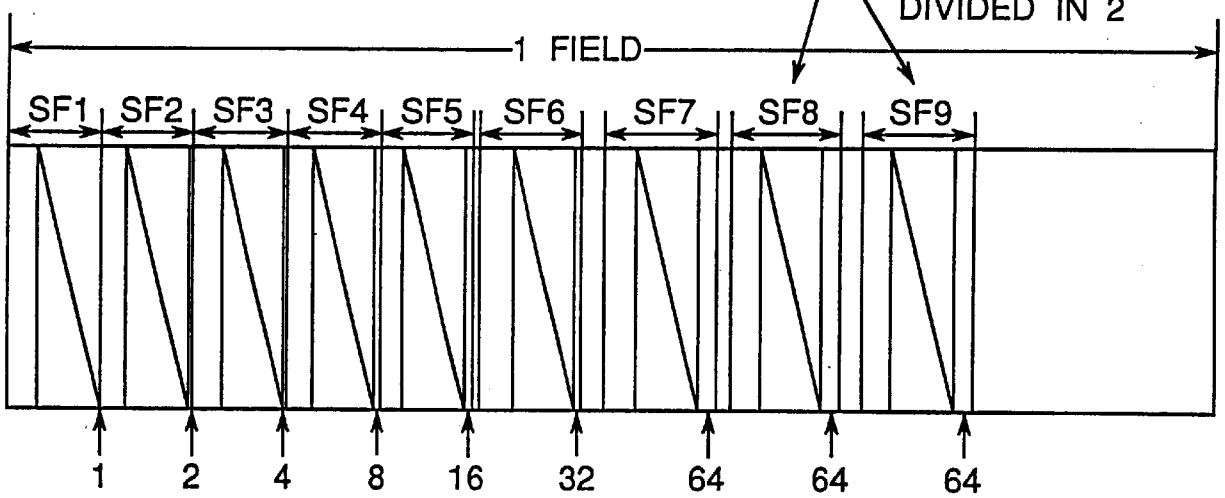
FIG. 7B shows a waveform diagram similar to that shown in FIG. 7A, but has subfields increase by one.
Figures 8A, 8B:
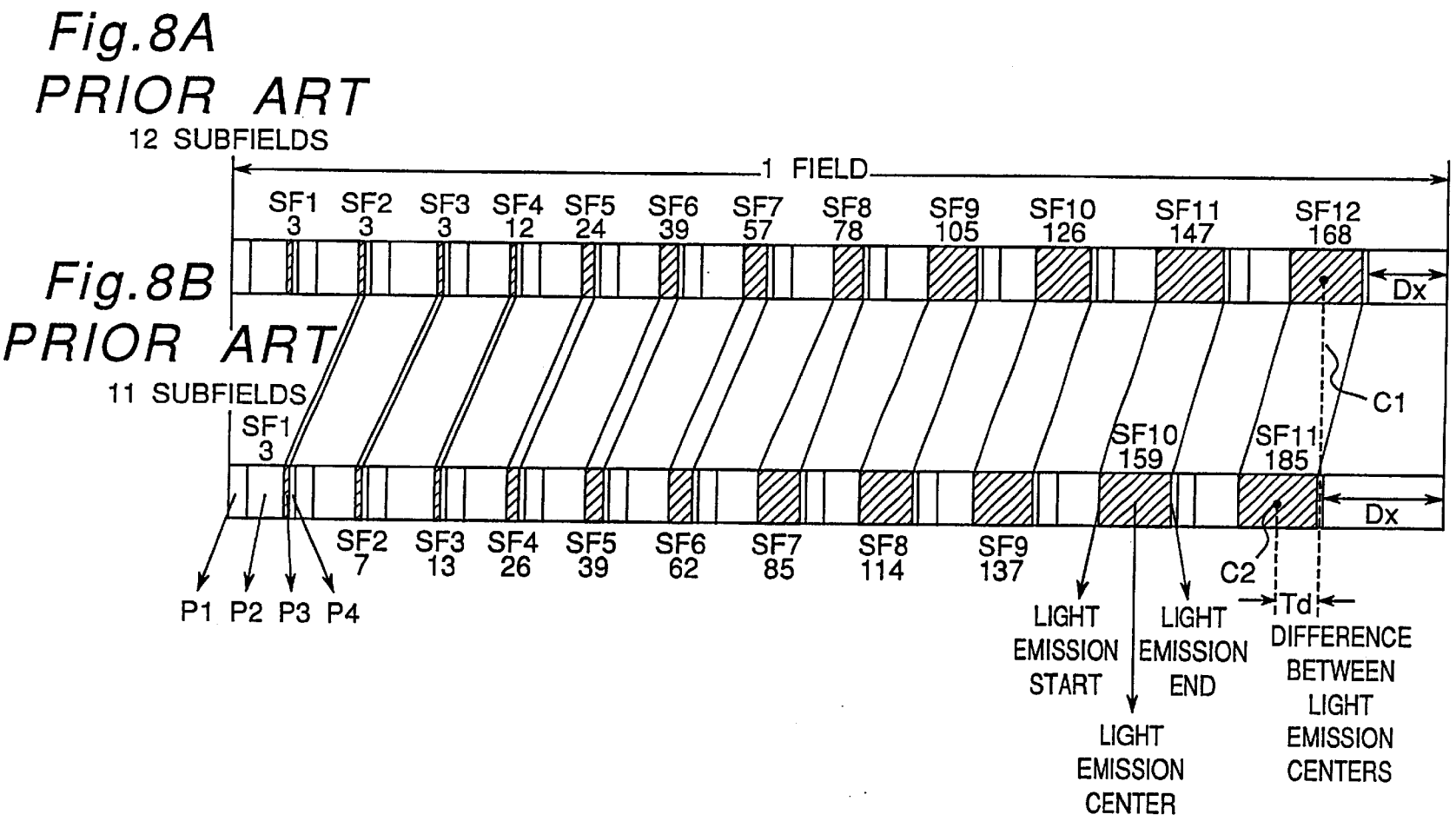
Fig.8A PRIOR ART
Fig.8B PRIOR ART
FIGS. 8A and 8B show waveform diagrams of a PDP driving signal in accordance with a prior art arrangement.

This delay time Dx is equivalent to the time length of the blank space portion shown at the right end of the PDP driving signal shown in FIG. 8. When Dx is calculated in the case of subfield number 8 of Table 1, the following results.

$$Dx=16.666-(5.395+0.040)=11.231 \text{ ms}$$

The calculated delay time Dx is sent to a delay device 10, and a PDP driving signal sent from the subfield processor 8 is delayed by the delay time Dx.

Figures 10A, 10B:
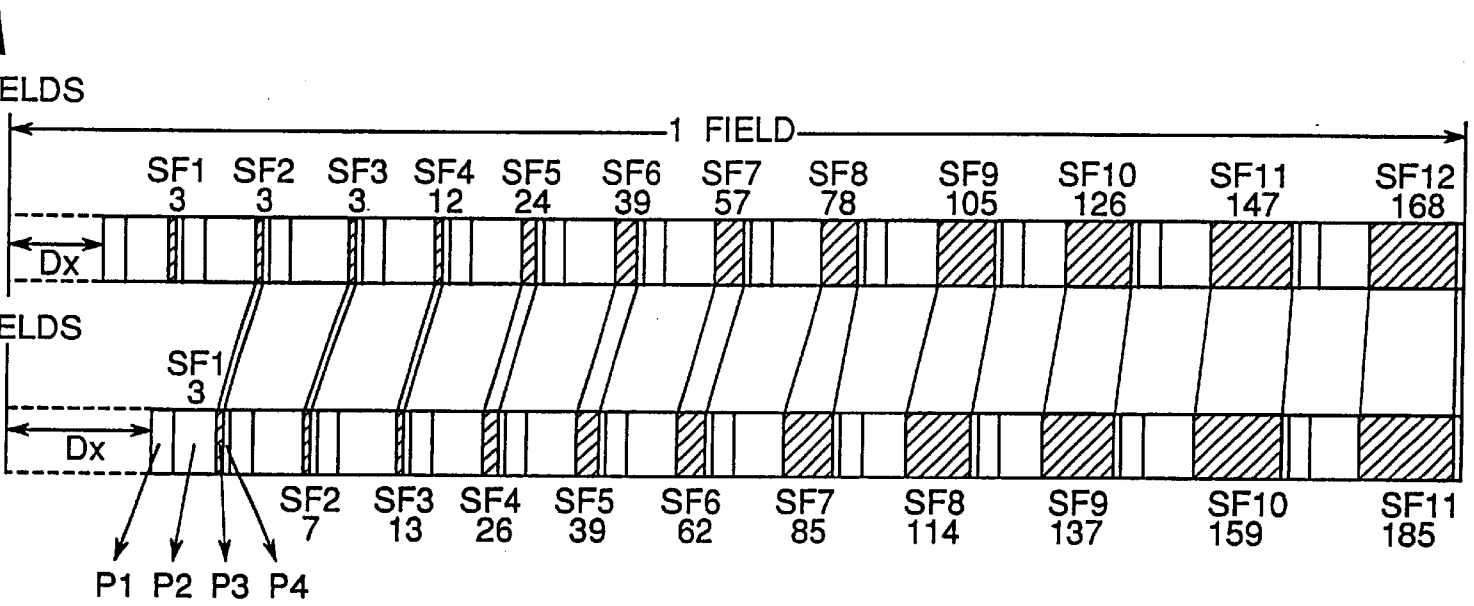
FIGS. 10A and 10B show waveform diagrams of a PDP driving signal obtained using the apparatus of FIG. 9.

FIG. 10 shows a PDP driving signal outputted from the delay device 10. As shown in FIG. 10, a signal outputted from the delay device 10 constitutes a signal that is delayed by the delay time Dx of the PDP driving signal of FIG. 8, that is, a signal, for which the light emission end point Le of the most-weighted subfield corresponds to the end point of each field time. This is achieved by making use of the fact that, in addition to subfields being arranged in order in each field from the subfield with the least number of light emissions to the subfield with the most, the most-weighted subfield appears last, and by moving to the left end of the PDP driving signal the time length of the blank space portion shown at the right end of the PDP driving signal prior to delay.

By so doing, it becomes possible to position the light emission center point of a most-weighted subfield at approximately the same location in each field, enabling the prevention of unnatural brightness changes.

Figure 11:
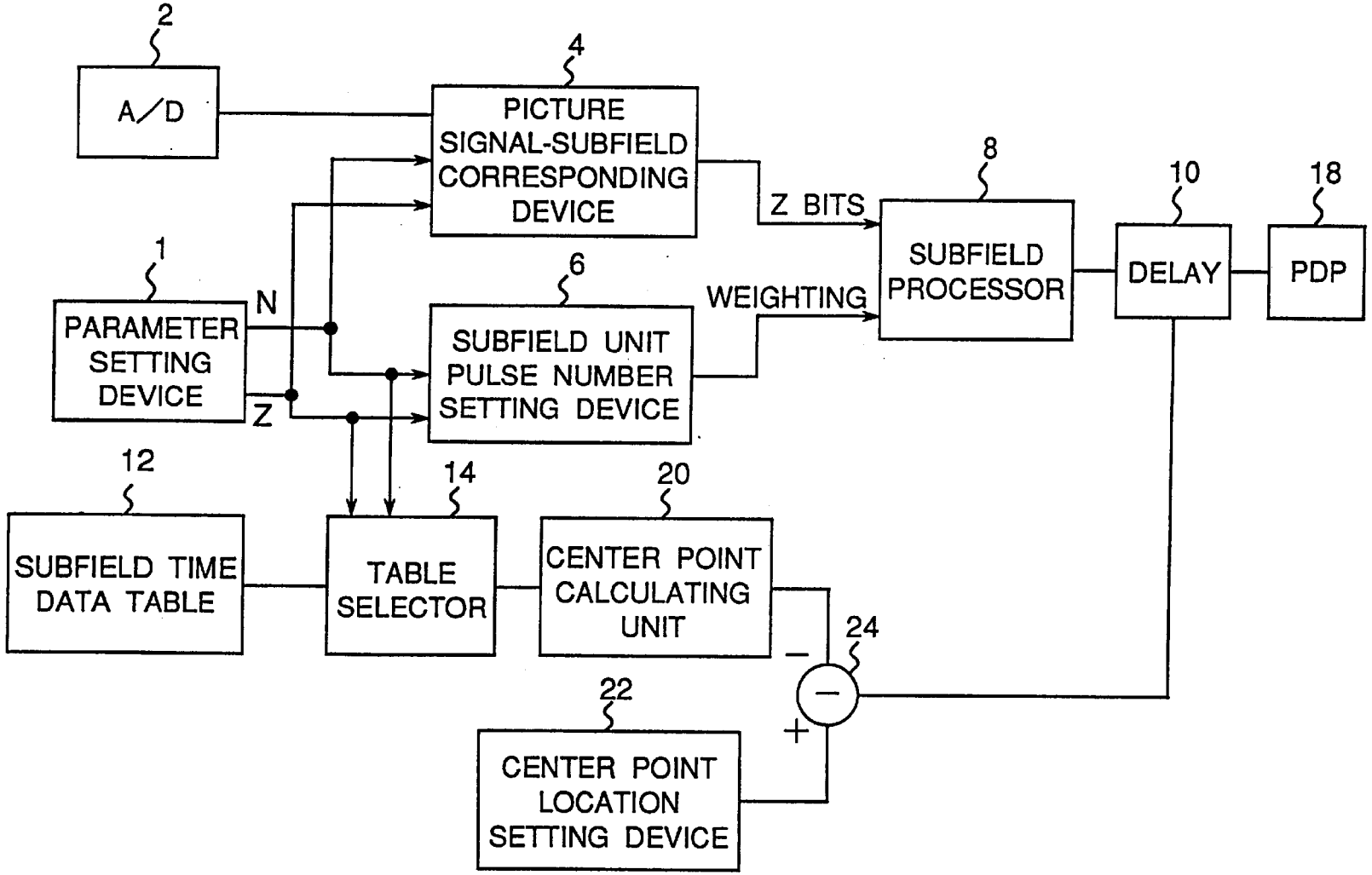
FIG. 11 shows a block diagram of a PDP display drive pulse controller of a second embodiment.

FIG. 11 shows a second embodiment of a PDP display drive pulse controller for preventing light emission center fluctuation, related to the present invention. In FIG. 11, the parameter setting device 1, A/D converter 2, picture signal-subfield corresponding device 4, subfield unit pulse number setting device 6, and subfield processor 8 are the same as the first embodiment shown in FIG. 9.

The subfield time data table 12 also holds the above-described Table 1, Table 2, Table 3, Table 4, Table 5 similar to the above-described first embodiment.

The table selector 14 receives a subfield number Z and a weighting multiplier N, and, in addition to selecting a table that accords with the multiplier N, obtains from the selected table the light emission start point Ls and light emission end point Le of a most-weighted subfield that accords with the subfield number Z.

A center point calculating unit 20 finds the light emission center point C of the light emission start point Ls and light emission end point Le using the following formula (4).

$$C=(Ls+Le)/2 \quad (4)$$

As is clear from this formula (4), the light emission center point C of a most-weighted subfield changes as a result of changes in the light emission start point Ls and light emission end point Le. When the light emission center point C of the most-weighted subfield is calculated for subfield number 8 of Table 1, the following results.

$$C=(4.755+5.395)/2=5.075 \text{ ms}$$

A center point location setting device 22 sets the location Kc, where the light emission center point of the most-weighted subfield should be, for all possible fields. The location Kc is determined by the following formula (5).

$$Kc=C\max+\alpha \quad (5)$$

Here, Cmax is the light emission center point C when the light emission end point Le of the most-weighted subfield takes the largest value (in the above-described example, this would be 14.530 for subfield number 14 of Table 6). Further, a becomes the value that satisfies the following formula (6).

$$C\max+\mathrm{Max}\{f(SFM)\times P3\}2+P4+\alpha<Ft \quad (6)$$

Furthermore, Max{f(SFM)×P3} represents the maximum light emission length. The maximum light emission length in the above-described described example is 3.840 ms when the subfield number in Table 6 is 8. When α is calculated in accordance with the above-described example, the following results.

$$\alpha<16.666-(14.530+3.840/2+0.040)$$

$$\alpha<0.176$$

Now, if α is set to 0.170, the location Kc where the light emission center point of the most-weighted subfield should be is as follows for the above-described example.

$$Kc=14.530+0.170=14.700 \text{ ms}$$

A subtracting unit 24 subtracts the light emission center point C calculated from location Kc, and calculates a delay time Dx' using the following formula (7).

$$Dx'=Kc-C \quad (7)$$

When Dx' is calculated for subfield number 8 of Table 1 in accordance with the above-described example, the following results.

$$Dx'=14.700-5.075=9.725 \text{ ms}$$

The subtraction result Dx' is inputted to the delay device 10, and the PDP driving signal is outputted by delaying it by the subtraction result Dx'.

Figures 12A, 12B:
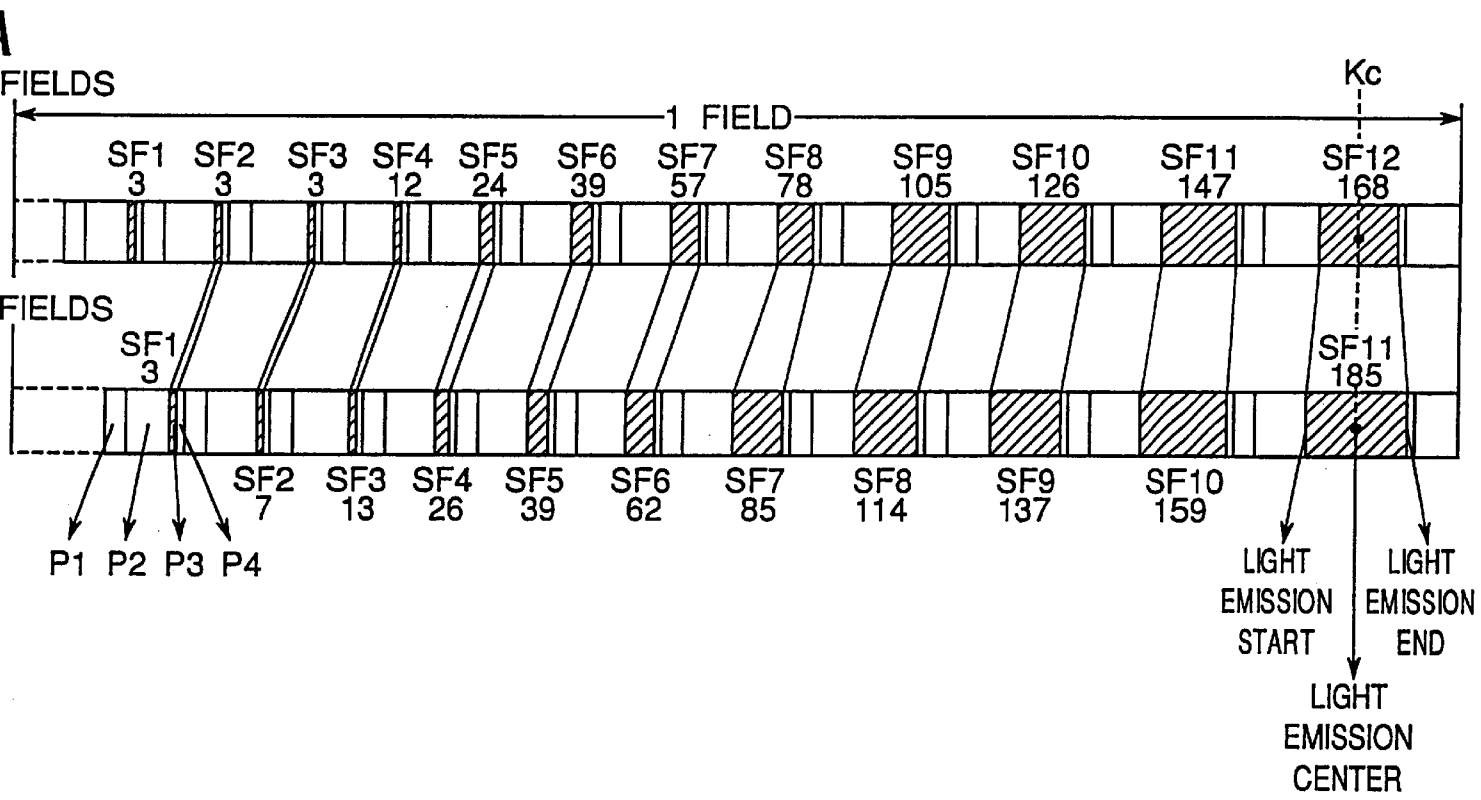
FIGS. 12A and 12B show waveform diagrams of a PDP driving signal obtained using the apparatus of FIG. 11.

FIG. 12 shows a PDP driving signal outputted from the delay device 10 of FIG. 11. As is clear from FIG. 12, the light emission center point C of the most-weighted subfield can be matched up with location Kc for all fields. In accordance with this, it becomes possible to prevent an unnatural fluctuation in brightness.

Further, by setting location Kc to a value such as that described above, it is accommodated inside a field no matter what most-weighted subfield appears at the end of the field.

The above-described second embodiment was explained with regard to when light emission is performed in order from the subfield with the least number of light emissions to the subfield with the most number of light emissions for all fields, but the same holds true for when the most-weighted subfield comes at the head, and comes in the middle of a field, making it possible to line up the light emission center points of most-weighted subfields.

What is claimed is:

1. A drive pulse controller for creating, for each image, a number of subfields Z from a first subfield to a Zth subfield in accordance with Z bit representation of each pixel, and a weighing value for each subfield, the drive pulse controller comprising:

a system that determines a number of subfields Z based on brightness information;

a time data source that stores light emission time data in association with the number of subfields Z, the light emission time data identifying a time location of a most-weighted subfield, the most-weighted subfield being a subfield that has a largest number of light emissions of all subfields;

a system that selects the light emission time data for the most-weighted subfield in accordance with the determined number of subfields Z;

a system that calculates a delay time for locating the most-weighted subfield at substantially a same position within a field period in accordance with the selected light emission time data, even when the number of subfields Z in the field is changed; and a delay system that delays a drive pulse in accordance with the calculated delay time.

2. The drive pulse controller according to claim 1, wherein the light emission time data, which is stored in said time data source, is a light emission end point of the most-weighted subfield.

3. The drive pulse controller according to claim 1, wherein the light emission time data, which is stored in said time data source, is a light emission start point and a light emission end point of the most-weighted subfield.

4. The drive pulse controller according to claim 2, wherein said system calculating said delay time calculates a time difference between the light emission end point of the most-weighted subfield and an end point of the field.

5. The drive pulse controller according to claim 3, wherein said system calculating said delay time calculates a time difference between a light emission center point, which is in the center between the light emission start point and the light emission end point, and a predetermined point within the field.

6. A drive pulse control method for a display that creates, for each image, a number of subfields Z from a first subfield to a Zth subfield in accordance with Z bit representation of each pixel, and a weighing value for each subfield, the drive pulse control method comprising:

determining a number of subfields Z based on brightness information;

storing, in advance, a time data source including light emission time data in association with the number of subfields Z, the light emission time data identifying a time location of a most-weighted subfield, the most-weighted subfield being a subfield that has a largest number of light emissions of all subfields;

selecting light emission time data in accordance with the determined number of subfields Z by reference to the time data source;

calculating a delay time for locating the most-weighted subfield at substantially a same position within a field period in accordance with the selected light emission time; and delaying a drive pulse in accordance with the calculated delay time.

7. The drive pulse control method according to claim 6, wherein the light emission time data, which is stored in the time data source, is a light emission end point of the most-weighted subfield.

8. The drive pulse control method according to claim 6, wherein the light emission time data, which is stored in the time data source, is a light emission start point and a light emission end point of the most-weighted subfield.

9. The drive pulse control method according to claim 7, wherein the calculating calculates a time difference between the light emission end point of the most-weighted subfield and an end point of the field.

10. The drive pulse control method according to claim 8, wherein the calculating calculates a time difference between a light emission center point, which is in the center between the light emission start point and the light emission end point, and a predetermined point within the field.

* * * * *